United States Patent [19]

Campbell et al.

[11] Patent Number: 4,862,814

[45] Date of Patent: Sep. 5, 1989

[54] PULVERIZED FUEL BURNER

[75] Inventors: Brian Campbell, Drummoyne; Craig Foreman, St. Ives; Peter Vierboom, Turramurra, all of Australia

[73] Assignee: The University of Sydney, Sydney, Australia

[21] Appl. No.: 226,769

[22] Filed: Aug. 1, 1988

[30] Foreign Application Priority Data

Aug. 13, 1987 [AU] Australia ..... P13713

[51] Int. Cl.[4] ..... F23D 1/02

[52] U.S. Cl. ..... 110/264; 110/263; 110/347; 431/263

[58] Field of Search ..... 110/261, 262, 263, 264, 110/265, 347; 431/263

[56] References Cited

U.S. PATENT DOCUMENTS 4,279,206 7/1981 Pitts et al. ..... 110/263

4,438,707 3/1984 Delaplace et al. ..... 110/264

4,474,120 10/1984 Adrian et al. ..... 110/261

*Primary Examiner*—Edward G. Favors

*Attorney, Agent, or Firm*—Abelman Frayne Rezac & Schwab

[57] ABSTRACT

A burner which is suitable for use in combusting pulverized coal and which can be used as an igniter for igniting the main burners in steam raising plant. The burner has an electrically powered torch which generates a continuous plasma which extends into a devolatilization zone of the burner, and primary conduits are provided for directing a primary supply of dense phase pulverized coal into the devolatilization zone. The burner is constructed also to include a combustion zone which surrounds the devolatilization zone, and secondary conduits are provided for directing a secondary supply of pulverized coal into the combustion zone along with a supply of combustion supporting air. In operation of the burner the secondary supply of pulverized coal is entrained in the air and is carried into the combustion zone by way of a swirl device and, once in the combustion zone, the coal-air mixture is contacted by partially combusted volatiles and carbon particles that move radially outward from the devolatilization zone.

9 Claims, 3 Drawing Sheets

PULVERISED COAL
14
15
16
FLUIDISER
AIR SUPPLY
10
ARC TORCH
BURNER
12
11
13
POWER SUPPLY
PRESSURISED GAS SUPPLY

PULVERIZED FUEL BURNER

FIELD OF THE INVENTION

This invention relates to a burner which is suitable for use in the combustion of pulverised coal, including both brown coal and black coal. The burner has been developed primarily as an igniter for use in igniting the main burners in steam raising plant which is employed in electric power generation, and the invention is hereinafter described in such context. However, it will be understood that the invention does have broader application, in the sense that it may be embodied in a burner per se for use in various applications.

BACKGROUND OF THE INVENTION

Steam raising plant which uses pulverised coal requires igniters for igniting the main burners, and the igniters may also be used, either alone or in conjunction with other burners, for providing supplementary energy for warm-up and flame stabilisation under reduced load conditions. The igniters have traditionally been fueled with gas or oil, and this has added significantly to both the capital and operating costs of the plant.

Attempts have been made to obviate the need for gas and oil igniters and to provide igniters that are fueled with pulverised coal. (P.R. Blackburn) U.S. Pat. No. 4,089,628 discloses an elementary burner arrangement in which an electric arc heated high velocity oxidising gas is used to ignite pulverised coal. The coal is delivered to the burner in an air stream and the coal-air mixture is contacted by a jet of the hot oxidising gas in a combustion chamber region of the burner. The hot gas jet is maintained in contact with the coal-air stream until there is sufficient ignition energy to ignite the pulverized coal, although the jet might be sustained after ignition has occurred in order to stabilise burning.

It is clear that this elementary igniter could not be made to work other than under optimum conditions and, thus, a different igniter design would need be created to meet different flow rate or coal-air mixture requirements and for burning different types of coal.

(D.A. Smith et al.) U.S. Pat. No. 4,221,174 discloses an igniter which also has been designed for direct ignition and combustion of pulverised coal. The igniter includes a source of pressurised air which is injected into a pulverised coal-air fuel stream at periodic intervals to create an air-to-coal weight ratio which varies cyclically with time and which, therefore, provides optimum conditions for ignition and flame propagation during a part of every cycle. Ignition is effected by a high energy spark which is excited at a rate greater than the rate of variation in the air-tc-coal weight ratio, and ignition occurs when optimum conditions exist. However, a significant feature of the device is that the source of ignition is discontinuous and this tends to reduce its reliability.

(M.E. Smirlock et al) U.S. Pat. No. 4,228,747 and (D.A. Smith et al.) U.S. Pat. No. 4,241,673 also disclose igniters which are intended to effect direct ignition of pulverised coal. These igniters both employ retractable electric spark producing mechanisms which are used only to initiate ignition of the pulverised coal, but they are otherwise somewhat similar to the more elementary igniter which is disclosed in U.S. Pat. No. 4,089,628.

One feature which is common to the igniters disclosed in all of the above referenced patents is that the air-entrained coal is delivered to a combustion zone of the igniters by way of a single channel and, thus, the igniting mechanism (be it in the form of a gas torch or a spark generator) is required to effect instantaneous combustion of the full or normal coal supply to the igniter.

SUMMARY OF THE INVENTION

The present invention distinguishes over the prior art devices in that it provides a burner which is suitable for use in combusting pulverised coal and which comprises a torch for generating a continuous plasma. An inner wall surrounds and preferably projects ahead of the torch, the wall defining in part a devolatilisation zone which projects ahead of the torch. Means are provided for energising the torch and for introducing a plasma supporting gas into the torch in a manner such that the plasma is caused to expand into the devolatilisation zone. An outer wall surrounds and projects ahead of the inner wall and it defines in part a combustion zone of the burner. The combustion zone surrounds the devolatilisation zone. At least one primary conduit is provided for directing a primary supply of dense phase pulverised coal into the devolatilisation zone. A channel region is defined by the inner and outer walls and it forms a region through which combustion supporting air is directed in use of the burner, and at least one secondary conduit is provided for delivering a secondary supply of pulverised coal to the combustion zone, the secondary conduit having an open delivery end located within the channel region whereby the secondary supply of pulverised coal is entrained by the combustion supporting air as it passes through the channel region.

In use of the burner, the expanding plasma provides a continuous source of ignition, in the sense that it causes devolatilisation of the primary supply of pulverised coal and, in the presence of combustion supporting gas, subsequent combustion. The resultant partially combusted volatiles and carbon particles then move outwardly into the combustion zone to cause ignition of the secondary supply of pulverised coal.

PREFERRED FEATURE OF THE INVENTION

The plasma torch preferably comprises an electrically powered torch but it might alternatively comprise a gas or liquid fuel burning torch which has a sufficiently high energy output to cause devolatilisation of dense phase coal which is directed into the devolatilisation zone. When electrically powered, the plasma torch preferably comprises spaced-apart electrodes between which an electric arc discharge may be maintained, a heating chamber defined by one of the electrodes, and means for admitting a pressurised supply of non-combustible gas to the heating chamber.

The invention will be more fully understood from the following description of a preferred embodiment of a burner which is intended to be used as an igniter in steam raising plant. The description is given with reference to the accompanying drawings.

DETAILED DESCRIPTION OF THE INVENTION

Figure 1:
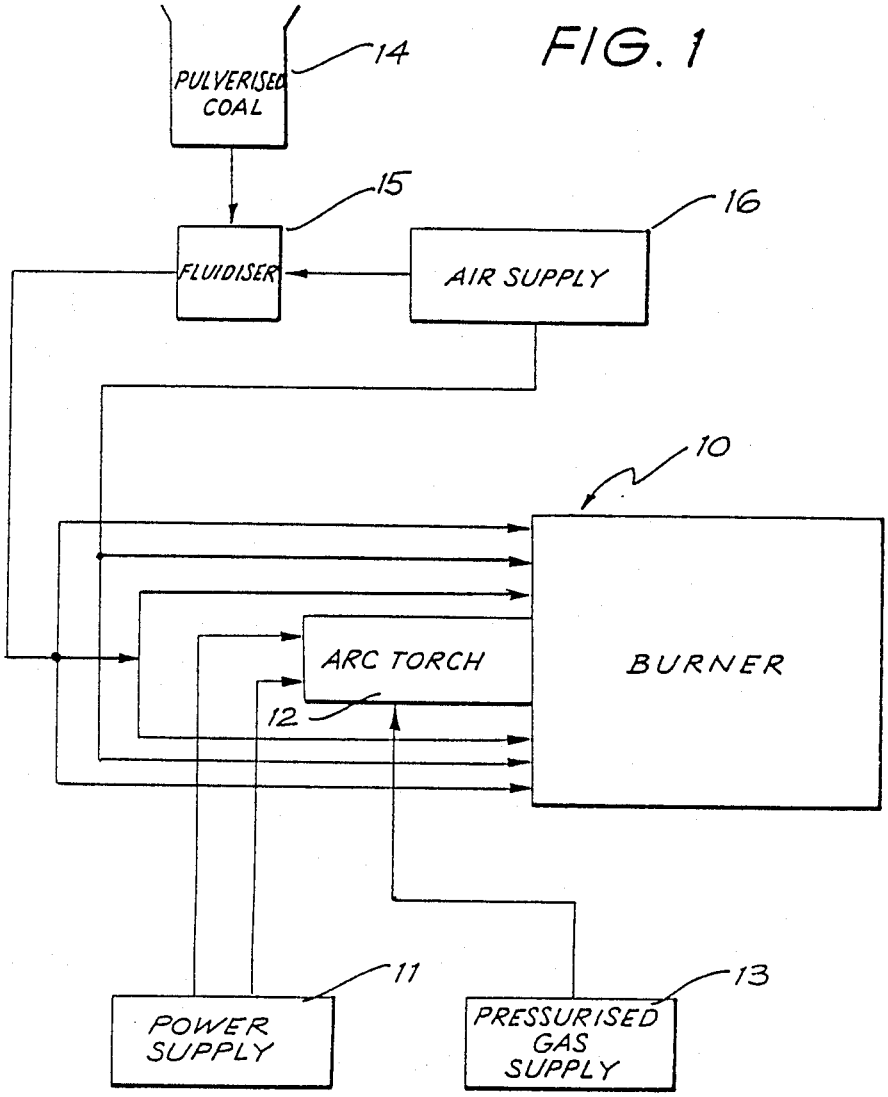
FIG. 1 shows a schematic representation of the burner connected in circuit with a pulverised coal supply and gas supplies.

The arrangement shown in FIG. 1 comprises a single burner 10 which normally would be mounted through the wall of a boiler. The burner may be located adjacent each of a number of main burners (not shown) or be located centrally within a group of main burners. Thus, depending upon the boiler construction and capacity, one burner may be provided for each main burner or for a group of main burners.

An electrical power supply 11 is provided for starting and maintaining an electric arc within an arc torch portion 12 of the burner 10. Also, a pressurised gas supply 13 is provided for delivery to the arc torch 12, for use as an arc carrier gas. The carrier gas may comprise air or nitrogen.

A supply 14 of pulverised coal is connected to the burner 10 by way of a fluidiser 15. A pressurised supply 16 of air is provided for use in fluidising and carrying the coal to the burner, and an air supply is provided for directing air into the burner for supporting combustion of the coal within a combustion zone of the burner.

Figure 2:
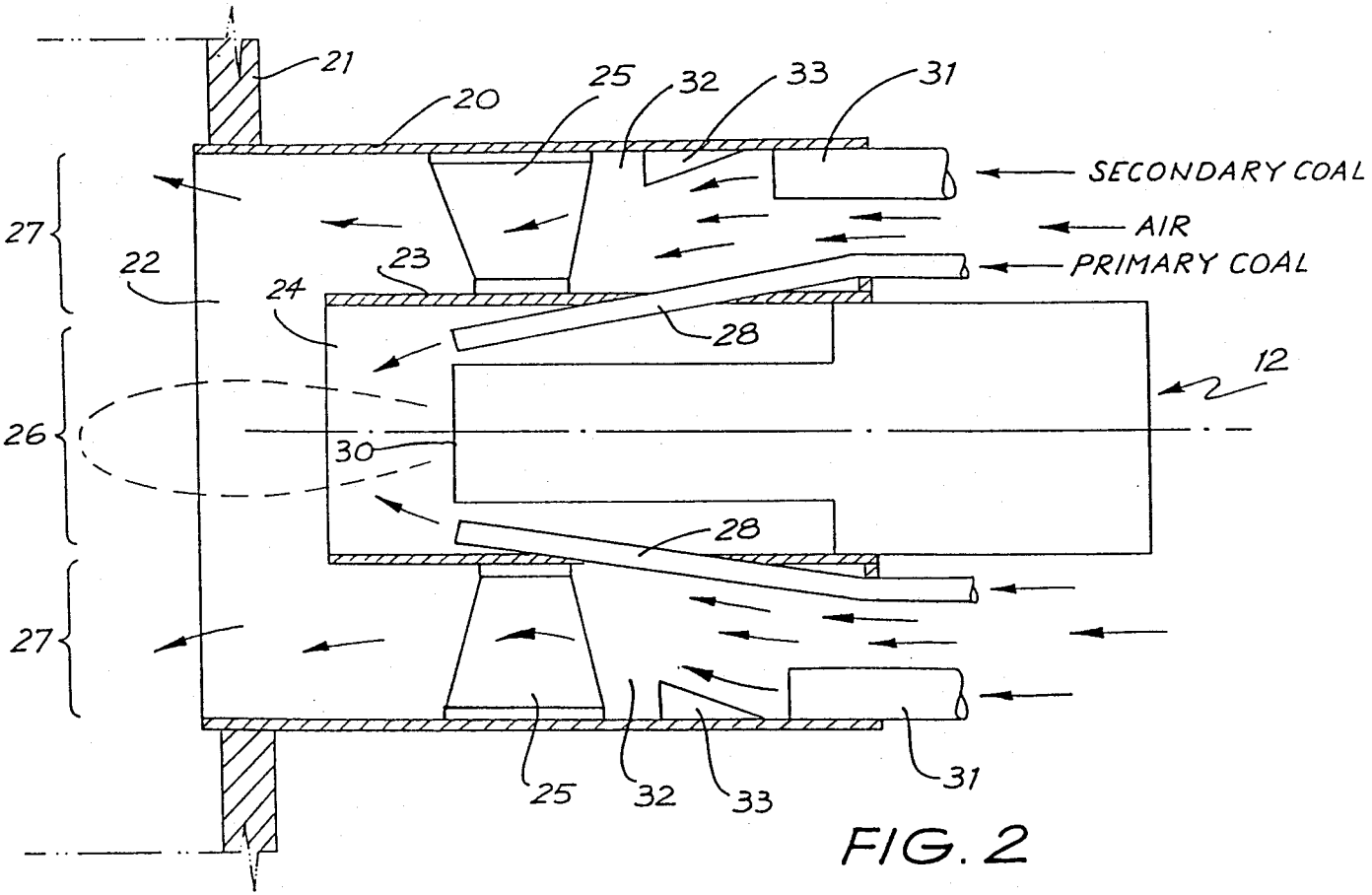
FIG. 2 shows a sectional elevation view of the burner.

Except for the burner 10, all of the components shown in FIG. 1 may be of conventional design and construction, and they require no further description. The burner itself is described in more detail with reference to FIGS. 2 and 3.

The burner assembly 10 comprises a generally cylindrical casing 20 which is constructed to be mounted to a wall 21 of a boiler. The casing has an open forward end 22 which is exposed to the interior of the boiler furnace and, unlike most known prior art igniters, the burner of the present invention does not (or need not) incorporate a quarl or cone at the entrance to the furnace wall.

The arc torch 12 projects into and extends for a major portion of the length of an inner cylinder 23, the inner cylinder having an open forward end 24 which is spaced rearwardly from the open end of the outer casing 20. An annular swirl device 25 is located about the inner cylinder 23 and extends between the inner cylinder and the outer casing 20. The swirl device 25 incorporates a plurality of stationary blades or vanes which have the appearance of turbine blades, and the swirl device functions to impart a spiral flow to fluid which is directed through the device. Thus, the fluid flows in the general direction indicated by the arrows and, as a consequence o f passing through the swirl device 25, in a circular direction.

Although not structurally separated, the forward end of the burner may be regarded as having two notionally separate zones, a devolatilisation zone 26 which projects ahead of the arc torch 12 and which is defined in part by the open forward end of the inner cylinder 23, and a surrounding combustion zone 27.

Two conduits 28 enter the burner from the rear end thereof and they extend through the wall of the inner cylinder 23 to lie adjacent the arc torch 12. The conduits 28 terminate adjacent the end 30 of the torch and they are orientated to direct a primary supply of dense phase pulverised coal into the devolatilisation zone 26.

Two further conduits 31 project into an annular region 32 between the outer and inner casings 20 and 23 and carry a secondary supply of dense phase pulverised coal into the annular region. Wedge-shaped deflectors 33 are located adjacent the ends of the conduits 31 and function to distribute the pulverised coal around a major portion of the annular region 32.

The burner described thusfar would normally be located within or be formed as an extension of a tubular structure (not shown) which serves to direct supplementry air into and through the annular region 32.

Figure 3:
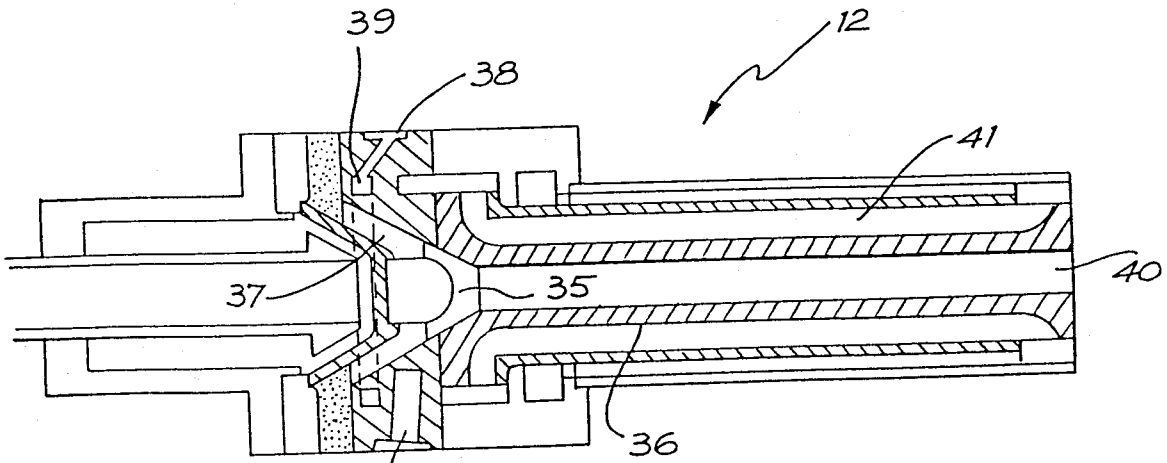
FIG. 3 shows a more detailed sectional elevation view of an electric arc torch portion of the burner.

As illustrated in FIG. 3, the arc torch 12 has a central cathode 35 and a cylindrical anode 36, both of which are connected to the power supply 11. The cathode is located within a generally conical chamber 37 and the pressurised arc carrier gas is delivered to the chamber 37, from the source 13, by way of a connecting port 38 and an annulus 39. The anode 36 defines a central heating chamber 40 in which the arc carrier gas is excited to an elevated energy level in the order of 200 to 3000 KJ/mole.

The arc carrier gas is delivered to the chamber 40 under pressure and flow rate conditions sufficient to extend the arc for a major part of the length of the chamber 40. The arc voltage is typically 100 to 300 volts and the arc current is typically in the range 150 to 800 amps.

Although the relevant connections are not shown in the drawings, coolant fluid is delivered to the arc torch and flows through and around the channel 41 which surrounds the anode 36, and a high energy arc striking mechanism 42 is located in a wall portion of the torch surrounding the cathode 35. An aperture is located in the wall of the torch and connects with the anode to permit passage of an electrical discharge plasma between the arc striking mechanism and the cathode.

In operation of the above described burner, dense phase pulverised coal from the primary supply conduits 28 is directed into an expanding arc plasma stream which enters the devolatilisation zone 26 from the arc torch 12. Rapid devolatilisation occurs and the volatiles move radially outwardly to enter the combustion zone 27 along with hot carbon particles. The partially combusted volatiles and carbon particles then react with the secondary supply of pulverised coal which enters the combustion zone 27 along with the combustion supporting air, and combustion occurs.

The primary supply of dense phase pulverised coal which is directed into the devolatilisation zone 26 by way of the conduits 28 has a coal:air mix ratio in the order of 10:1 (by weight), and the secondary supply of pulverised coal which is directed into the annular zone 32 by way of the conduits 31 has a similar mix ratio. However, when blended with the further supply of air which is directed into the annular zone 32, the resultant mixture which is passed through the swirl 25 to enter the combustion zone 27 has a coal:air mix ratio in the order of 1:10. The coal itself is pulverised to a size smaller than 300 micrometres.

We claim:

1. A burner which is suitable for use in combusting pulverized coal and which comprises a torch for generating a continuous plasma, an inner wall surrounding the torch, the wall defining in part a devolatilization zone which projects ahead of the torch, means for energising the torch and for introducing a plasma supporting gas into the torch in a manner such that the plasma is caused to expand into the devolatilization zone, an outer wall which surrounds and projects ahead of the inner wall and which defines in part a combustion zone of the burner, the combustion zone surrounding the devolatilization zone, at least one primary conduit for directing a primary supply of dense phase pulverized coal into the devolatilization zone, a channel region defined by the inner and outer walls and forming a region through which combustion supporting air is directed in use of the burner, and at least one secondary conduit for delivering a secondary supply of pulverized coal to the combustion zone, the secondary conduit having an open delivery end located within the channel region whereby coal passing into the channel region from the secondary conduit is in use of the burner entrained in the combustion supporting air and carried forward into the combustion zone where it is contacted by partially combusted volatiles and carbon particles that move outwardly from the devolatilization zone.

2. The burner as claimed in claim 1 wherein the inner wall projects ahead of the torch.

3. The burner as claimed in claim 2 wherein a swirl inducing device is located in the channel region ahead of the secondary conduit, the swirl inducing device being arranged to impart a spiral flow component to air-entrained coal as it passes into the combustion zone from the channel region.

4. The burner as claimed in claim 3 wherein a deflector device is positioned between the open delivery end of the or each secondary conduit and the swirl device, the deflector device being shaped to effect diffusion of the secondary coal supply as it enters the channel region from the secondary conduit.

5. The burner as claimed in claim 4 wherein the or each primary conduit has an open delivery end positioned adjacent a forward end portion of the torch.

6. The burner as claimed in claim 5 wherein the or each primary conduit has its open delivery end portion located within the inner wall of the burner.

7. The burner as claimed in claim 5 wherein the open delivery end of the secondary conduit is positioned within the channel region rearwardly of the open delivery end of the primary conduit.

8. The burner as claimed in claim 1 wherein the inner and outer walls are cylindrical and wherein the channel region defined by such walls has an annular cross-section.

9. The burner as claimed in claim 1 wherein the torch comprises an electrically powered plasma torch having spaced-apart electrodes between which an electrical arc discharge is maintained in use of the burner, a heating chamber defined by one of the electrodes and means for admitting a pressurized supply of the plasma supporting gas to the heating chamber.

* * * * *